US007326870B2

(12) United States Patent
Lin et al.

(10) Patent No.: US 7,326,870 B2
(45) Date of Patent: Feb. 5, 2008

(54) KEY MODULE AND MANUFACTURING METHOD THEREOF

(75) Inventors: Chun-Wei Lin, I Lan Hsien (TW); Yu-Tsai Wang, Taipei Hsien (TW); Yu-Yen Lien, Taipei Hsien (TW)

(73) Assignee: Silitech Technology Corp., Taipei Hsien (TW)

( * ) Notice: Subject to any disclaimer, the term of this patent is extended or adjusted under 35 U.S.C. 154(b) by 352 days.

(21) Appl. No.: 11/196,253

(22) Filed: Aug. 4, 2005

(65) Prior Publication Data

US 2007/0029182 A1 Feb. 8, 2007

(51) Int. Cl.
*H01H 13/14* (2006.01)
*H01H 11/00* (2006.01)

(52) U.S. Cl. ..... 200/341; 200/512; 29/622

(58) Field of Classification Search ..... 200/5 A, 200/512, 517, 314, 329, 341–345; 341/22; 345/168–170; 29/622; 455/550.1, 575.1, 455/575.3, 575.4
See application file for complete search history.

(56) References Cited

U.S. PATENT DOCUMENTS 5,865,302 A * 2/1999 Suzuki et al. ..... 200/315
6,023,033 A * 2/2000 Yagi et al. ..... 200/512
6,455,796 B2 * 9/2002 Kashino ..... 200/512
6,737,596 B1 * 5/2004 Hein ..... 200/310
6,967,056 B2 * 11/2005 Kashino ..... 200/341
6,993,830 B2 * 2/2006 Shimizu et al. ..... 29/622
7,027,036 B2 * 4/2006 Yang ..... 345/170
7,099,465 B2 * 8/2006 Nishi ..... 200/341
7,119,296 B1 * 10/2006 Liu et al. ..... 200/341

* cited by examiner

*Primary Examiner*—Michael A Friedhofer
(74) *Attorney, Agent, or Firm*—Rabin & Berdo, P.C.

(57) ABSTRACT

A key module and its manufacturing method are provided in the present invention. The steps of the method include: providing a mold; forming a key body having multiple opening portions on the mold; jostling a combination of a display body and an elastic body to the key body; and finally, tightly attaching the display body to the key body and stuffing the display body into the opening portions of the key body. Therein, the elastic body has a lower end formed with a contact block contacting a circuit board. By compressing, injecting or infusing a silicone rubber material or an elastic material into the opening portions, the gap located between the key body and the display body or between the key body and the elastic body is smaller than 0.01 mm. Thus, the appearance of the key module of the present invention is almost seamless.

32 Claims, 4 Drawing Sheets

KEY MODULE AND MANUFACTURING METHOD THEREOF

BACKGROUND OF THE INVENTION

1. Field of the Invention

The present invention is related to a key module and its manufacturing method, and more particularly, to an integrated key module that is made by jostling a combination of a display body and an elastic body to a key body so that the combination of the display body and the elastic body are closely attached to the key body.

2. Description of Related Art

With the arrival of the age of information technologies and the progress of Internet technologies for communication, mobile phones, also called cellular phones, have become one of the most popular communication tools. Since mobile phones are compact, easily carried and low-cost and have multiple functions, they are used more and more extensively these days. In general, when consumers purchase a mobile phone, they are concerned mostly with the functionality and appearance of the mobile phone. In order to meet these requirements, various mobile phones with numerous functions and attractive appearance are introduced every year to the market.

Commonly, the key module of a conventional mobile phone that is compact in size is made of finished products or semi-finished products of various components such as metal, plastic or silicone rubber and are first made and then combined with a mobile phone via attachment or adhesion methods.

Reference is made to FIG. 1, which is a schematic diagram of a conventional key module that has a gap between the combined components. As shown in FIG. 1, due to the limit of conventional manufacturing capabilities, a gap A, which is about 0.03 mm, is required for combining an upper component 1*a* having opening portions with a matching component 2*a*. However, the gap A usually ruins the esthetic appearance and the tightness of the product. Thus, it is undesirable for manufacturers and users.

Accordingly, as discussed above, the prior art still has some drawbacks that could be improved upon. The present invention aims to resolve the drawbacks of the prior art.

SUMMARY OF THE INVENTION

An objective of the present invention is to provide a key module and its manufacturing method. Via a specific manufacturing process, the appearance of the key module is almost seamless. Thus, an integrated, compact and thin key module is formed. The present invention can compress, inject or infuse silicone rubber (or an elastic material) into opening portions to make the gap located between the key body and display body or between the key body and the elastic body smaller than 0.01 mm.

For reaching the objective above, the present invention provides a method for manufacturing a key module, including: providing a mold; forming a key body having multiple opening portions on the mold; jostling a combination of a display body and an elastic body to the key body; and finally, tightly attaching the display body to the key body and stuffing the display body into the opening portions of the key body. Therein, the elastic body has a lower end formed with a contact block contacting a circuit board.

For reaching the objective above, the present invention also provides a method for manufacturing a key module, including: providing a mold; forming a key body having multiple opening portions on the mold; jostling a combination of a display body, a first elastic body and a second elastic body to the key body; and finally, tightly attaching the first elastic body to the key body and stuffing the first elastic body into the opening portions of the key body. Therein, the second elastic body has a lower end formed with a contact block contacting a circuit board.

For reaching the objective above, the present invention provides a key module, including a key body, a display body and an elastic body. The key body has multiple opening portions. The display body is tightly integrated with and covered on a surface of the key body and tightly stuffed into the opening portions of the key body. The elastic body is tightly integrated with and covered on a surface of the display body and has a lower end formed with a contact block.

For reaching the objective above, the present invention provides another key module, including a key module, including a key body, a first elastic body, a display body and a second elastic body. The key body has multiple opening portions. The first elastic body is tightly integrated with and covered on a surface of the key body and tightly stuffed into the opening portions of the key body. The display body is tightly integrated with and covered on a surface of the first elastic body. The second elastic body is tightly integrated with and covered on a surface of the display body and has a lower end formed with a contact block.

Numerous additional features, benefits and details of the present invention are described in the detailed description, which follows.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF PREFERRED EMBODIMENTS

Figure 1:
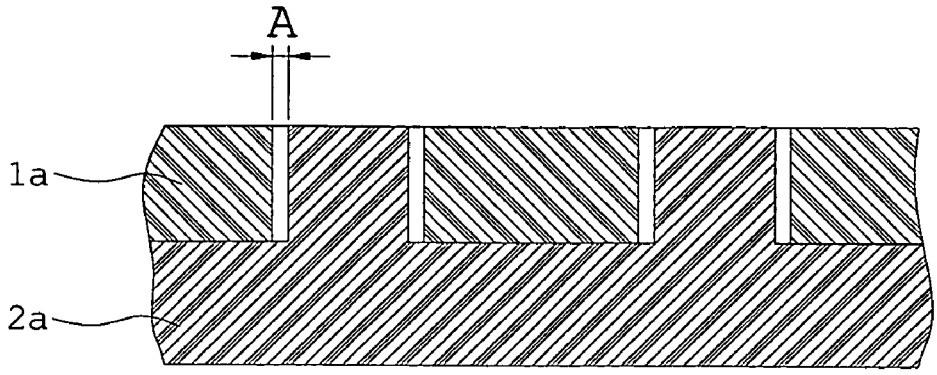
FIG.1 PRIOR ART
FIG. 1 is a schematic diagram of a conventional key module that has a gap between the combined components.
Figure 2:
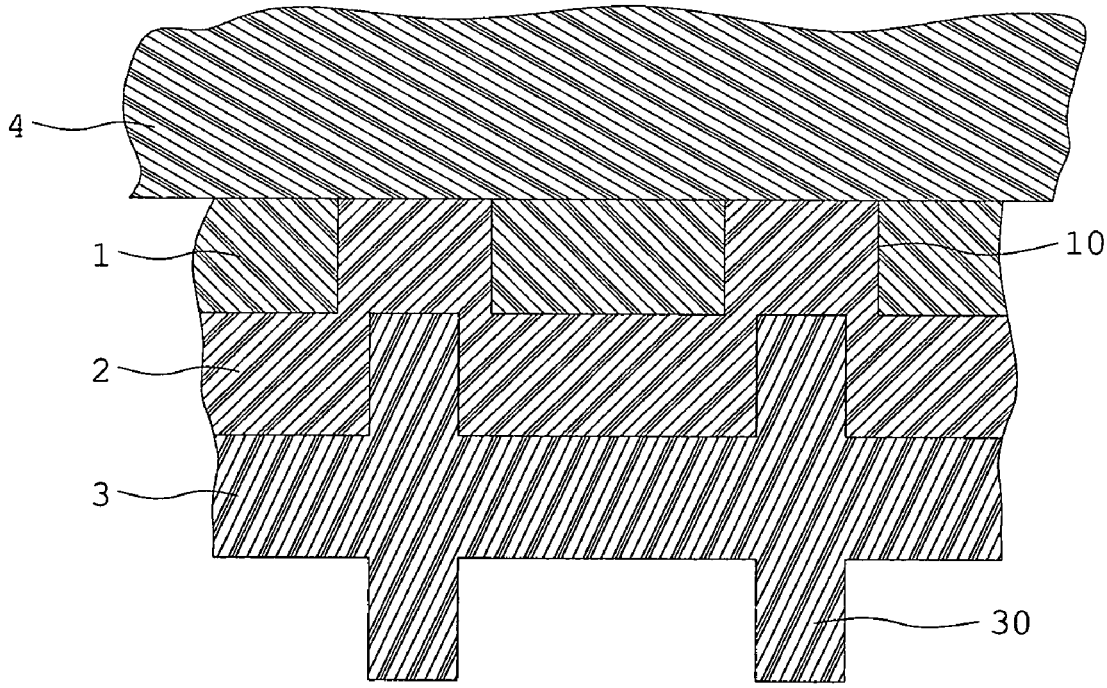
FIG. 2 is a cross-sectional diagram of the first embodiment of a key module in accordance with the present invention.

Reference is made to FIG. 2, which is a cross-sectional diagram of the first embodiment of a key module in accordance with the present invention. As shown in FIG. 2, the present invention provides a key module that includes a key body 1, a display body 2 and an elastic body 3.

The key body 1 has multiple opening portions 10 and is made of a metal or plastic material. The key body 1 is covered and integrated with the display body 2. The opening portions 10 are stuffed tightly with the display body 2. Thus, the key body 1 and the display body 2 both have a surface located along the same plane. The display body 2 is a membrane that can be colored or have written text printed on it. The design of the key body 1 itself or the opening portions 10 of the key body 1 allow the color or text to be seen. Moreover, due to the tight combination of the key body 1 and the display body 2, the gap located therebetween is reduced effectively to 0.01~0.03 mm.

In addition, the elastic body 3 is made of a silicone rubber or plastic material. It is integrated tightly with and covers the display body 2. The elastic body 3 further has a contact block 30, which is used to contact a circuit board (not shown) located below the key module for signal transfer.

Figure 3:
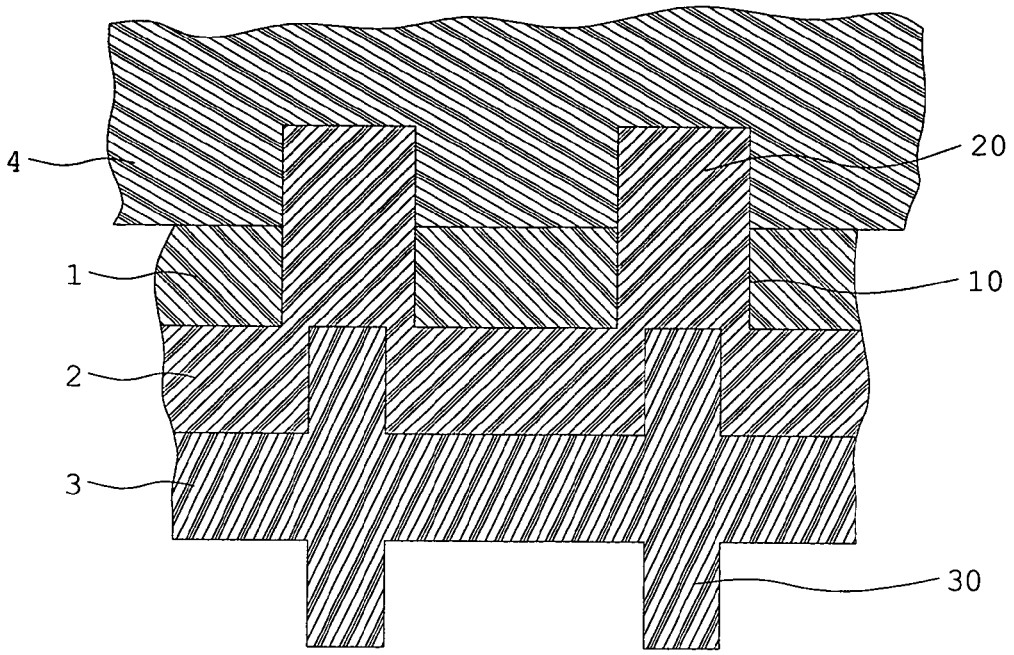
FIG. 3 is a cross-sectional diagram of the second embodiment of the key module in accordance with the present invention.

Reference is made to FIG. 3, which is a cross-sectional diagram of the second embodiment of the key module in accordance with the present invention. As shown in FIG. 3, the difference between the first and second embodiments is that the display body 2 of the second embodiment further has multiple projective portions 20 that pass through the opening portions 10 and project from the surface of the key body 1. The projective portions 20 create a three-dimensional feeling when a user presses the key module, and further provide a three-dimensional appearance.

Figure 4:
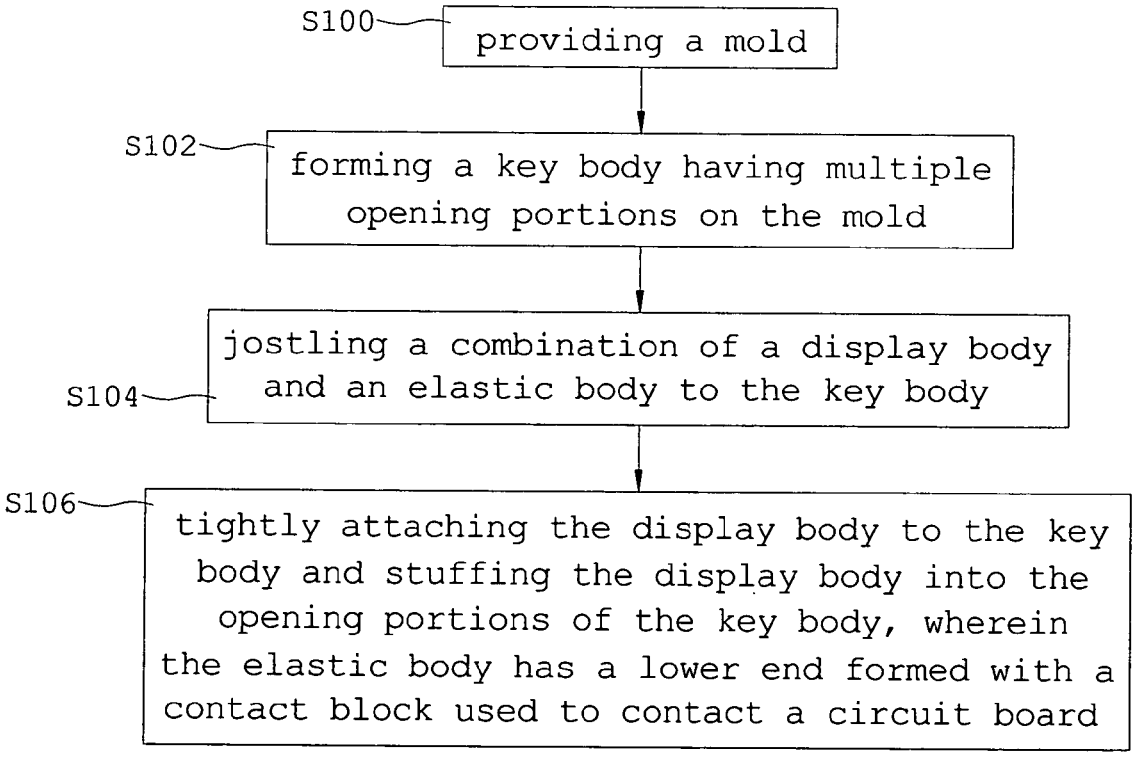
FIG. 4 is a flow chart of a method for manufacturing the first and second embodiments of the key module in accordance with the present invention.

Reference is made to FIG. 4, which is a flow chart of a method for manufacturing the first and second embodiments of the key module in accordance with the present invention. As shown in FIG. 4, the present invention provides a method for manufacturing a key module including the following steps. First, a mold is provided (S100). Next, a key body 1 having multiple opening portions 20 is formed on the mold (S102). The key body 1 is made of a metal or plastic material. Then, a combination of a display body 2 and an elastic body 3 is jostled to the key body 1 (S104). Finally, the display body 2 is attached tightly to key body 1 and stuffed into the opening portions 10 of the key body 1; furthermore, a contact block 30 contacting a circuit board (not shown) is formed at the lower end of the elastic body 3 (S106). The jostling process can be performed by compression, injection or infusion molding. However, the present invention is not limited thereto. All of the processes that are capable of integrating the key body 1, the display body 2 and the elastic body 3 at the same time can be applied for the present invention.

Furthermore, the mold can be a plane mold 4 that is parallel to the surface of the key body 1. Via the plane mold 4, the surfaces of the display body 2 and the key body 1 are positioned along the same plane. In addition, the mold can also be a mold 5 that has indentations corresponding to the opening portions 10 of the key body 1. Via the mold 5, the projective portions 20 of the display body 2 that project from the surface of the key body 1 are formed.

Figure 5:
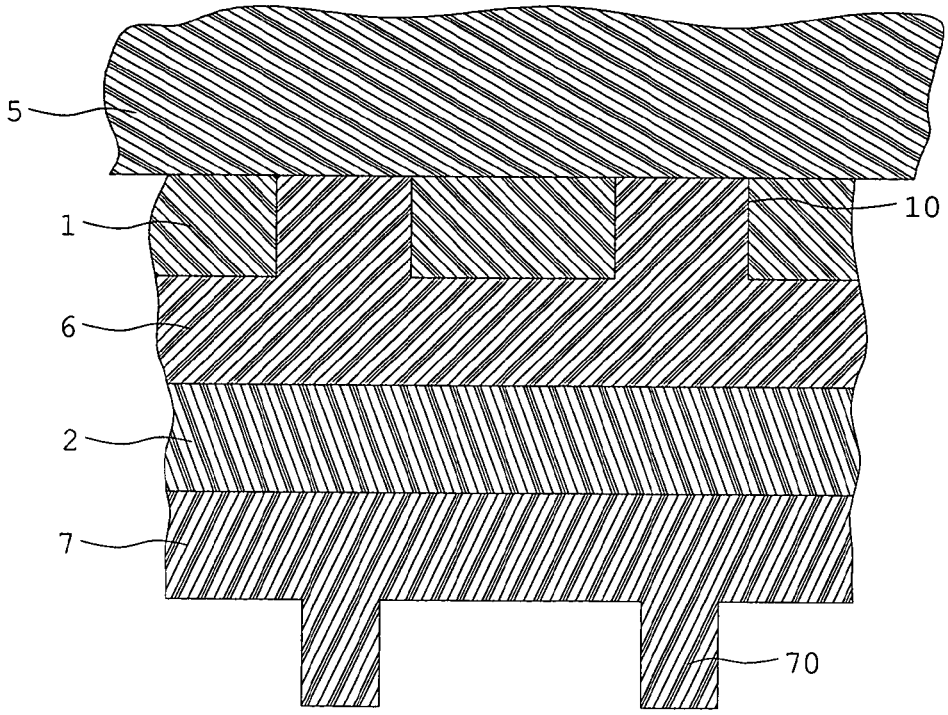
FIG. 5 is a cross-sectional diagram of the third embodiment of the key module in accordance with the present invention.

Reference is made to FIG. 5, which is a cross-sectional diagram of the third embodiment of the key module in accordance with the present invention. As shown in FIG. 5, the present invention provides a key module that includes a key body 1, a display body 2, a first elastic body 6 and a second elastic body 7.

The key body 1 has multiple opening portions 10 and is made of a metal or plastic material. The key body 1 is covered and integrated with the first elastic body 6. The opening portions 10 of the key body 1are stuffed tightly with the first elastic body 6. Thus, the key body 1 and the first elastic body 6 both have a surface located along the same plane.

Furthermore, the first elastic body 6 is covered and integrated with the display body 2. The display body 2 is a membrane that can be colored or have written text printed on it. The design of the key body 1 itself, the opening portions 10 of the key body 1 and the first elastic body 6 allow the color or text to be seen. Thus, the key module of the present invention creates an aesthetically pleasing appearance.

Moreover, the second elastic body 7 is covered and integrated tightly with the surface of the display body 2. The second elastic body 7 further has a contact block 70, which contacts a circuit board (not shown) located below the key module for signal transfer. In addition, the first elastic body 6 and the second elastic body 7 are made of a silicone rubber or plastic material. Due to the tight combination of the key body 1 and first elastic body 6, the gap located therebetween is reduced effectively to 0.01~0.03 mm.

Figure 6:
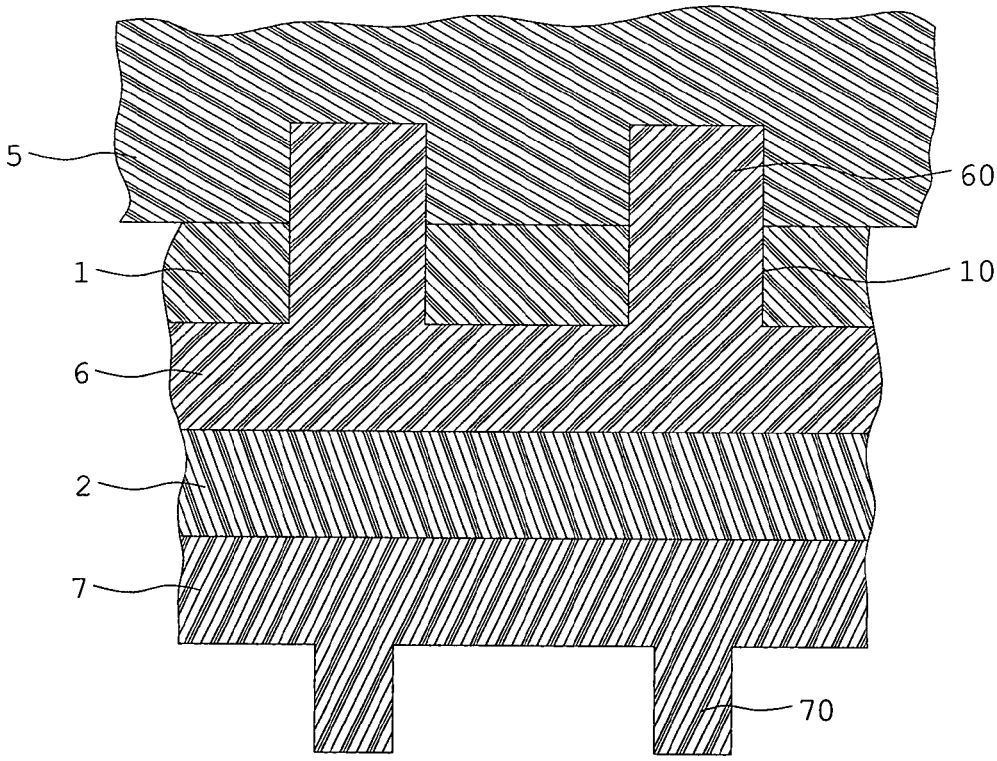
FIG. 6 is a cross-sectional diagram of the fourth embodiment of the key module in accordance with the present invention.

Reference is made to FIG. 6, which is a cross-sectional diagram of the fourth embodiment of the key module in accordance with the present invention. As shown in FIG. 6, the difference between the third and fourth embodiments is that the first elastic body 6 of the fourth embodiment further has multiple projective portions 60 that pass through the opening portions 10 and project from the surface of the key body 1. The projective portions 60 create a three-dimensional feeling when a user presses the key module, and further provide a three-dimensional appearance.

Figure 7:
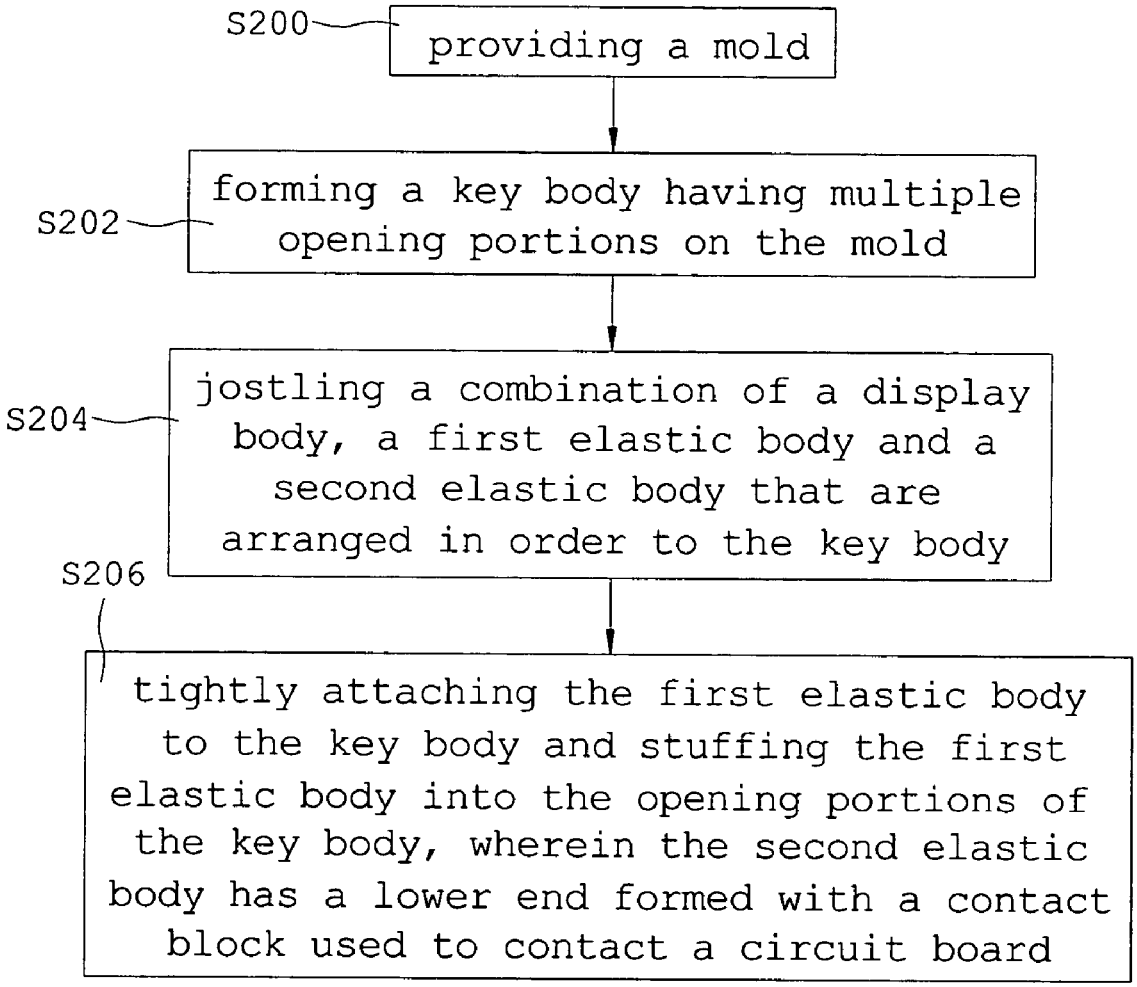
FIG. 7 is a flow chart of a method for manufacturing the third and fourth embodiments of the key module in accordance with the present invention.

Reference is made to FIG. 7, which is a flow chart of a method for manufacturing the third and fourth embodiments of the key module in accordance with the present invention. As shown in FIG. 7, the present invention provides a method for manufacturing a key module including the following steps. First, a mold is provided (S200). Next, a key body 1 having multiple opening portions 20 is formed on the mold (S202). The key body 1 is made of a metal or plastic material. Then, a combination of a display body 2, a first elastic body 6 and a second elastic body 7 that are arranged in order is jostled to the key body 1 (S204). The jostling process can be performed by compression, injection or infusion molding. However, the present invention is not limited thereto. All of the processes that are capable of tightly integrating the key body 1, the display body 2, the first elastic body 6 and the second elastic body 7 at the same time can be applied for the present invention.

Finally, the first elastic body 6 is attached tightly to key body 1 and stuffed into the opening portions 10 of the key body 1. Furthermore, a contact block 30 contacting a circuit board (not shown) is formed at the lower end of the second elastic body 7 (S206).

Furthermore, the mold can be a plane mold 4 that is parallel to the surface of the key body 1. Via the plane mold 4, the surfaces of the first elastic body 6 and the key body 1 are positioned along the same plane. In addition, the mold can also be a mold 5 that has indentations corresponding to the opening portions 10 of the key body 1. Via the mold 5, the projective portions 60 of the first elastic body 6 that project from the surface of the key body 1 are formed.

To sum up, in the present invention, by compressing, injecting or infusing a silicone rubber material or an elastic material into the opening portions, the gap located between the key body 1 and the display body 2 or between the key body 1 and the first elastic body 6 is smaller than 0.01 mm. Thus, the appearance of the key module of the present invention is almost seamless.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are embraced within the scope of the invention as defined in the appended claims.

What is claimed is:

1. A method for manufacturing a key module, comprising:

providing a mold;

forming a key body having a plurality of opening portions on the mold;

jostling a combination of a display body and an elastic body to the key body; and tightly attaching the display body to the key body and stuffing the display body into the opening portions of the key body, wherein the elastic body has a lower end formed with a contact block for contacting a circuit board.

2. The method as claimed in claim 1, wherein the mold is a plane mold parallel to a surface of the key body.

3. The method as claimed in claim 2, wherein the plane mold makes the surface of the key body and a surface of the display body positioned along a same plane.

4. The method as claimed in claim 1, wherein the mold has indentations corresponding to the opening portions of the key body.

5. The method as claimed in claim 1, wherein the mold has indentations to make the display body have projecting portions that project from a surface of the key body.

6. The method as claimed in claim 1, wherein the key body is made of a metal material or a plastic material.

7. The method as claimed in claim 1, wherein the display body is a membrane with color or written text.

8. The method as claimed in claim 7, wherein the color or the written text of the display body can be seen due to a design of the key body or the opening portions of the key body.

9. The method as claimed in claim 1, wherein the elastic body is made of a silicone rubber material or a plastic material.

10. A method for manufacturing a key module, comprising:

providing a mold;

forming a key body having a plurality of opening portions on the mold;

jostling a combination of a display body, a first elastic body and a second elastic body that are arranged in order to the key body; and tightly attaching the first elastic body to the key body and stuffing the first elastic body into the opening portions of the key body, wherein the second elastic body has a lower end formed with a contact block used to contact a circuit board.

11. The method as claimed in claim 10, wherein the mold is a plane mold parallel to a surface of the key body.

12. The method as claimed in claim 11, wherein the plane mold makes the surface of the key body and a surface of the display body positioned along a same plane.

13. The method as claimed in claim 10, wherein the mold has indentations corresponding to the opening portions of the key body.

14. The method as claimed in claim 10, wherein the mold has indentations to make the display body have projecting portions that project from a surface of the key body.

15. The method as claimed in claim 10, wherein the key body is made of a metal material or a plastic material.

16. The method as claimed in claim 10, wherein the display body is a membrane with color or written text.

17. The method as claimed in claim 16, wherein the color or the written text of the display body can be seen due to a design of the first elastic body, the second elastic body, the key body or the opening portions of the key body.

18. The method as claimed in claim 10, wherein the first elastic body and the second elastic body are made of a silicone rubber material or a plastic material.

19. A key module, comprising:

a key body having a plurality of opening portions;

a display body tightly integrated with and covered on a surface of the key body and tightly stuffed into the opening portions of the key body; and an elastic body tightly integrated with and covered on a surface of the display body and having a lower end formed with a contact block.

20. The key module as claimed in claim 19, wherein the key body and the display body both have a surface positioned along a same plane.

21. The key module as claimed in claim 19, wherein the display body further has a plurality of projecting portions that project from a surface of the key body.

22. The key module as claimed in claim 19, wherein the key body is made of a metal material or a plastic material.

23. The key module as claimed in claim 19, wherein the display body is a membrane with color or written text.

24. The key module as claimed in claim 23, wherein the color or the written text of the display body can be seen due to a design of the key body or the opening portions of the key body.

25. The key module as claimed in claim 19, wherein the elastic body is made of a silicone rubber material or a plastic material.

26. A key module, comprising:

a key body having a plurality of opening portions;

a first elastic body tightly integrated with and covered on a surface of the key body and tightly stuffed into the opening portions of the key body;

a display body tightly integrated with and covered on a surface of the first elastic body; and a second elastic body tightly integrated with and covered on a surface of the display body and having a lower end formed with a contact block.

27. The key module as claimed in claim 26, wherein the key body and the first elastic body both have a surface positioned along a same plane.

28. The key module as claimed in claim 26, wherein the first elastic body further has a plurality of projecting portions that project from a surface of the key body.

29. The key module as claimed in claim 26, wherein the key body is made of a metal material or a plastic material.

30. The key module as claimed in claim 26, wherein the display body is a membrane with color or written text.

31. The key module as claimed in claim 30, wherein the color or the written text of the display body can be seen due to a design of the first elastic body, the key body, the opening portions of the key body or the second elastic body.

32. The key module as claimed in claim 26, wherein the first elastic body and the second elastic body are made of a silicone rubber material or a plastic material.

* * * * *